US010184710B2

(12) United States Patent
Goerz

(10) Patent No.: US 10,184,710 B2
(45) Date of Patent: Jan. 22, 2019

(54) ICE MAKER TRAY WITH INTEGRATED FLOW CHANNEL FOR A FLUID, ICE MAKER AND HOUSEHOLD REFRIGERATION APPARATUS

(71) Applicant: BSH HAUSGERAETE GMBH, Munich (DE)

(72) Inventor: Alexander Goerz, Aalen (DE)

(73) Assignee: BSH Hausgeraete GmbH, Munich (DE)

( * ) Notice: Subject to any disclaimer, the term of this patent is extended or adjusted under 35 U.S.C. 154(b) by 43 days.

(21) Appl. No.: 15/258,102

(22) Filed: Sep. 7, 2016

(65) Prior Publication Data

US 2018/0066881 A1 Mar. 8, 2018

(51) Int. Cl.

| | |
|---|---|
| ***F25C 1/24*** | (2018.01) |
| ***F25C 5/08*** | (2006.01) |
| *F25B 39/02* | (2006.01) |

(52) U.S. Cl.

CPC ..... *F25C 1/24* (2013.01); *F25C 5/08* (2013.01); *F25B 39/02* (2013.01)

(58) Field of Classification Search

CPC ..... F25C 1/24; F25C 5/08; F25B 39/02

See application file for complete search history.

(56) References Cited

U.S. PATENT DOCUMENTS 2,181,580 A * 11/1939 Fitzsimmons ..... F25C 1/24 220/529
2,181,584 A * 11/1939 Gross ..... F25C 1/24 417/199.1
2,478,312 A * 8/1949 Peltier ..... F25C 1/24 62/356
3,144,078 A * 8/1964 Morton ..... F25C 1/04 165/263
5,038,470 A * 8/1991 Dierbeck ..... F28F 13/12 165/109.1
7,752,859 B2 7/2010 Lee et al.
2005/0126202 A1* 6/2005 Shoukyuu ..... F25C 1/24 62/351
2011/0162406 A1* 7/2011 Shin ..... F25C 1/24 62/351
2014/0150468 A1* 6/2014 Boarman ..... F25C 1/04 62/3.63
2014/0165643 A1* 6/2014 Boarman ..... F25C 1/10 62/340
2016/0245574 A1* 8/2016 Jeong ..... F25C 1/24

FOREIGN PATENT DOCUMENTS

WO 2016037908 A1 3/2016

* cited by examiner

*Primary Examiner* — Matthew J Daniels
*Assistant Examiner* — Leith S Shafi
(74) *Attorney, Agent, or Firm* — Laurence A. Greenberg; Werner H. Stemer; Ralph E. Locher

(57) ABSTRACT

The invention relates to ice maker trays, wherein an ice maker tray can have the following:

a tray body form areas for presetting forms for ice form elements to be produced, wherein these form areas are integrated in the tray body, a flow channel for a fluid, wherein the flow channel is integrated in the tray body, wherein the flow channel has a channel axis, and the flow channel is closed in circumferential direction around the channel axis. The invention also relates to an ice maker and to a household refrigeration apparatus.

18 Claims, 3 Drawing Sheets

ICE MAKER TRAY WITH INTEGRATED FLOW CHANNEL FOR A FLUID, ICE MAKER AND HOUSEHOLD REFRIGERATION APPARATUS

TECHNICAL FIELD

The invention relates to an ice maker tray for an ice maker. Moreover, the invention also relates to an ice maker for a household refrigeration apparatus as well as to a household refrigeration apparatus.

PRIOR ART

Household refrigeration apparatuses are known in diverse configurations. Thus, refrigerators, freezers as well as combined refrigerators-freezers are known. It is also known that such household refrigeration apparatuses have an ice maker, by means of which ice form elements such as for example ice cubes or ice half moons can be produced. They can then be dispensed via a dispenser unit of the household refrigeration apparatus. Thus, it is known in this context that such a dispenser unit also has a dispensing unit disposed at a door of the household refrigeration apparatus. The door is formed for closing a receiving space for food and usually pivotably disposed at a housing of the household refrigeration apparatus. With closed door, dispensing of these ice form elements can be effected via a front-side recess in the door. In this context, it is also known that an ice maker has a refrigeration circuit. Heat is extracted from an interior of the ice maker by this refrigeration circuit such that the liquid introduced in the ice maker tray in local form areas freezes and the ice form elements arise.

In this context, the refrigeration circuit includes a heat exchanger and an evaporator, respectively.

In known implementations of ice makers, the ice rate, by which the amount of the ice capable of being produced per time unit is to be understood, is restricted.

Moreover, in known automatic ice makers for household refrigeration apparatuses, different types are also known, which can be differentiated concerning output of the produced ice form elements from the ice maker tray. A first type is characterized in that it has an ice maker tray twistable in itself, whereby the ice form elements produced in the form areas are virtually broken out by these twisting operations.

A further type of an ice maker is characterized in that it is referred to as so-called meltout ice maker. In these implementations, it is provided that a heating device is attached in particular to an ice maker tray. By this heating device, the ice maker tray is in particular heated in local positions, whereby slight meltout of these ice form elements is effected and thus release of these ice form elements from the form areas is particularly simply effected. Such a configuration has open groove structures, in which cold air flows. Such is for example known from U.S. Pat. No. 7,752,859 B2. By a fan disposed at a bottom of an ice maker tray, this cold air is here pressed into these grooves and flows along the bottom of the ice maker tray. Thus, a higher ice rate is to be achieved by this configuration.

Moreover, from WO 2016/037908 A1, an ice maker tray is known, which is disposed in a cooling device. The ice maker tray or ice form tray is therefore disposed in a housing in this implementation, which is constructed of two separate housing parts. A heat exchanger is also disposed in the housing. The heat exchanger is formed as a separate component from the ice maker tray. The ice maker tray contacts the heat exchanger and rests on this heat exchanger from above. Thereby, the process of ice production is to be accelerated. The heat exchanger is pressed to the bottom of the ice maker tray by spring elements. In these configurations from WO 2016/037908 A1, the number of structural members of the separate components is high and therefore the assembly effort is also increased. In all of the implementations mentioned there, it is also only possible to a limited extent to be able to increase the ice rate. By corresponding positional tolerances of the components to each other, which can also arise in the course of time, as well as by the diverse wall areas, cooling of the water in the ice maker tray and thus freezing of this liquid is associated with a corresponding expenditure of time here too.

PRESENTATION OF THE INVENTION

It is the object of the present invention to provide an ice maker tray, which is compactly constructed. Furthermore, it is the object of the invention to provide an ice maker tray, which is minimized in its number of structural members.

Moreover, it is the object of the present invention to provide an ice maker tray, by which the period of time for producing ice form elements in the ice maker tray is reduced due to the ice maker tray itself. An ice maker tray is to be provided, by which the ice rate can be increased.

Furthermore, it is the object of the present invention to provide an ice maker tray stable in itself, by which produced ice form elements can be simply output from the ice maker tray.

Moreover, it is the object of the present invention to provide an ice maker tray, which can be simply installed in an ice maker and simply be connected to further components of the ice maker, in particular to a refrigeration circuit.

Further, it is the object of the present invention to provide an ice maker, by which the ice rate can be increased.

It is also the object of the present invention to provide a household refrigeration apparatus, in which an ice rate is increased by an ice maker.

A first independent aspect of the invention relates to an ice maker tray or an ice form tray for an automatic ice maker of a household refrigeration apparatus. The ice maker tray has a tray body. Moreover, the ice maker tray has form areas for presetting forms for ice form elements to be produced. The form areas are formed integrated in the tray body. This means that these form areas are integrally formed in the tray body. The ice maker tray has a flow channel for a fluid or a refrigerant fluid, in particular of a refrigeration circuit. The flow channel is integrated in the tray body and thus formed integrally with the tray body. The flow channel has a channel axis, along which this flow channel forms or along which the flow channel extends. In particular, the flow channel is closed in circumferential direction around the channel axis. Therefore, in this aspect of the invention, an ice maker tray is proposed, which is reduced in its number of structural members. The tray body and the flow channel are not two separate components, which are each also geometrically bounded by own separate concrete wall areas, but the tray body itself has the flow channel integrally formed in this tray body itself. This flow channel allows an increased ice rate in the employment of the ice maker tray in the automatic ice maker and thus in the active operation by this configuration. By the integration of the flow channel, the thermodynamic effect for heat extraction from the form areas and thus also from the liquid in the form areas, which is to be frozen to ice form elements, is increased. A particularly efficient ice rate is allowed by such a configuration of the ice maker tray. Since a wall area bounding the form areas from the hollow space or the cavity of the flow channel is also formed in relatively thin manner by this configuration, this heat extraction from the form areas is particularly fast allowed compared to the known configurations of ice maker trays. Moreover, the assembly effort for components is omitted in such a configuration of an ice maker tray since they are integrated in the tray body. The number of structural members of this ice maker tray is particularly small. By the shape of the flow channel closed in circumferential direction around the channel axis, passing of the fluid without loss is allowed since fluid cannot escape from the flow channel perpendicularly to this channel axis. The heat extraction and the thermodynamic procedures in this flow channel for performing this heat extraction from form areas are thereby particularly efficiently allowed.

In an advantageous implementation, the tray body has a wall, which is produced or formed as an integral wall. This wall bounds the form areas with one surface and bounds the flow channel with an opposing surface. This is a very advantageous implementation since the integration of components is achieved to high extent. Therefore, this wall is formed with a first shaping at a surface, by which the form areas are then also preset as structural elements. This wall is formed different therefrom and thus differently structured at the opposing surface. Thereby, the requirements for integrated formation of form areas are accommodated on the one surface. On the other surface, the requirements to a desired and best possible flow behavior of a fluid flowing in the flow channel are accommodated. Thus, the wall has different geometric configurations on the opposing surfaces. Thus, two different components of the ice maker tray formed integrated in the tray body are bounded by a single wall. Preferably, this integral wall is then also configured thinner. Compared to the prior art, thus, the assembly effort is also omitted especially at this place. Moreover, positional tolerances can be avoided compared to two separate walls abutting on each other, which optionally bound the form areas on the one hand, bound the flow channel on the other hand. In particular, heat extraction from the form areas is allowed in particularly efficient and fast manner when the fluid then flows through this flow channel in the inserted and installed state of the ice maker tray in the ice maker and thermodynamic procedures for this heat extraction from the form areas appear or are performed in this flow channel.

Preferably, it is provided that this flow channel constitutes a partial element or a partial section of a pipeline system of a refrigeration circuit of the ice maker, which can then have the ice maker tray. Liquid or gaseous fluid or refrigerant or fluid or refrigerant present in a mixed form between liquid and gaseous can then flow through this flow channel and heat can be efficiently extracted from the ice maker tray, in particular the form areas.

Preferably, the tray body is formed of metal. Thereby, it is stable on the one hand, the fast heat extraction from the form areas is possible on the other hand. In particular, the tray body is formed of metal at least in the area of the flow channel and the form areas. It can be provided that the tray body is formed of aluminum or copper or zinc or steel or an alloy of at least two of these mentioned metals.

In a further advantageous implementation, the tray body is formed as a metal die casting component. Thereto, it can also be provided that mechanic post-processing steps are performed after the die casting process.

A further aspect of the invention relating to the ice maker tray is to be regarded in that the tray body has a first ice maker tray part, wherein the first ice maker tray part has the form areas. The form areas are formed integrated in this first ice maker tray part and thus integrally with the ice maker tray part. The tray body has a second ice maker tray part separate from the first ice maker tray part, which is connected to the first ice maker tray part. The flow channel is formed between the first ice maker tray part and the second ice maker tray part. The flow channel has a first channel wall bounding the flow channel, which is formed by a wall of the first ice maker tray part. In particular, the channel is directly bounded by this wall of the first ice maker tray part. The flow channel has a second channel wall bounding the flow channel, which is a channel wall separate from the first channel wall. The second channel wall is formed by a wall of the second ice maker tray part. The flow channel is also directly bounded by this further wall of the second ice maker tray part. The flow channel has a channel inlet, which is formed by at least one ice maker tray part. The flow channel has a channel outlet, which is formed by at least one ice maker tray part. This means that the channel outlet is bounded by at least one ice maker tray part. The same also applies to the channel inlet. In such a configuration, especially in complex shapes of the form areas and also correspondingly more complex shapings and form extensions of the flow channel, simpler possibilities of production for the ice maker tray arise. The form areas and in particular the flow channel can then be produced more precise in their shape. This then entails advantages for the flow behavior of the fluid in the flow channel.

In an advantageous implementation, it is provided that the first ice maker tray part is connected to the second ice maker tray part in hermetically sealed manner. Junctions are formed between the first ice maker tray part and the second ice maker tray part and these junctions are hermetically sealed. By this configuration, a fluid flowing through the flow channel is prevented from exiting from the flow channel in radial direction and thus perpendicularly to the channel axis. By such a configuration, a flow channel virtually assembled thereby also functionally complies with the requirements to a structural member of a refrigeration circuit as it is to be employed in particular in an ice maker.

In an advantageous implementation, it is provided that the first ice maker tray part has a geometry, which corresponds to a conventional meltout ice maker such that water introduced into the form areas can be frozen to ice form elements and can be twisted out by an ejector of the ice maker. Here, it can in particular be provided that this top tray, which the ice maker tray part can also be referred to as, can also be disposed in particular rotatable in an ice maker.

Preferably, the junctions between the ice maker tray parts, at which the ice maker tray parts then also directly abut on each other, are welded joints or solder joints or adhesive joints. By these specifications, the hermetic tightness is particularly advantageously achievable.

In an advantageous implementation, the channel inlet of the flow channel is completely disposed in the second ice maker tray part and the channel inlet is thus completely bounded by the second ice maker tray part. By this configuration, non-destructively non-detachable junctions between two separate ice maker trays are not formed especially at the channel inlet. Even if these junctions can be formed hermetically sealed, by such an integral configuration of the channel inlet only by a single ice maker tray part, the form precision is increased and the undesired exit of fluid in a direction perpendicular to the channel axis and thus in radial direction to the channel axis is avoided in a manner particularly to be emphasized. By such a configuration, inner sides of the channel inlet can then also be formed in very smooth manner and without jump or offset or without edge such that undesired turbulences do not occur at the channel inlet in passage of the fluid.

In an advantageous implementation, the channel outlet is completely disposed in the second ice maker tray part and thus completely bounded by the ice maker tray part. Here, the corresponding advantages apply as they were already mentioned for the configuration at the channel inlet.

In an advantageous implementation, the first ice maker tray part is formed as one piece and the second ice maker tray part is formed as one piece. In this configuration, the ice maker tray is therefore virtually formed by two separate parts, which are first provided and then connected in particular in non-destructively detachable manner such that an ice maker tray is then formed here too. In this configuration, the actual integral production effected in one process is then not performed, but two individual pieces are first produced and then provided in their final shape, which are then subsequently assembled in a further production step, in particular connected at junctions in non-destructively non-detachable manner.

In an advantageous implementation, the tray body has a surface increasing structure. By such a configuration, heat can be extracted from an environmental region, in particular the ambient air, which surrounds the ice maker tray in an ice maker, such that the effectiveness of increasing the ice rate is achieved.

In particular, the surface increasing structure is formed on an outer side of a channel wall, which bounds the flow channel. This channel wall opposes the channel wall, in which the form areas are also formed. In particular, the elements of the surface increasing structure are formed on a bottom of the ice maker tray in an intended arrangement of the ice maker tray. The surface increasing structure extends on an outer side of a channel wall of the flow channel, which faces away from the form areas.

Preferably, it is provided that the flow channel has a channel wall and the form areas are formed in this channel wall. The flow channel has a further channel wall and the surface increasing structure is formed by this further channel wall. In particular, the surface increasing structure has ribs as structural elements. The surface increasing structure is in particular integrated in the tray body. This surface increasing structure is therefore formed as one piece with the tray body, in particular thus also produced as one piece in one process. The junctions between the above mentioned ice maker tray parts are preferably planar connection areas.

In an advantageous implementation, it is provided that the surfaces of the ice maker tray parts, on which the junctions are to be formed, are processed, in particular processed by a grinding process. Thereby, the hermetically sealing connection is achievable in improved manner.

In an advantageous implementation, the flow channel has a channel inlet, a channel outlet and a channel main section. The channel main section is disposed between the channel inlet and the channel outlet viewed in the direction of the channel axis. The channel inlet has a cross-sectional area, which is smaller than a cross-sectional area of the channel main section. The cross-sectional areas are to be seen in planes disposed parallel to each other. The channel outlet has a cross-sectional area, which is smaller than a cross-sectional area of the channel main section. Here too, the cross-sectional areas are to be seen in planes oriented parallel to each other. Thus, the flow channel with its channel inlet, its channel outlet and its channel main section is formed with varying cross-section in this advantageous implementation. Thereby, fluidic advantages can be achieved. In particular advantageousness, it is thereby achieved that upon connecting the ice maker tray to a refrigeration circuit and thus coupling the ice maker tray to the refrigeration circuit, especially in this flow channel, which is integrated in the ice maker tray itself, thermodynamic procedures can be particularly advantageously effected to be able to cause a particularly fast heat extraction from the form areas of the tray body of the ice maker tray. In particular, it is thereby possible that a transition of the fluid flowing in the flow channel from a first aggregate state to a second aggregate state is effected in particularly advantageous manner, whereby the particularly fast heat extraction from the form areas is then achieved.

Preferably, it is provided that the flow channel has a channel inlet, which is formed as a connection nozzle and formed for connecting a further pipeline of a refrigeration circuit of an ice maker. A particularly simple yet secure connection between the flow channel in the ice maker tray and the further channel part or pipe part of a refrigeration circuit is thereby very simply yet securely allowed. By this configuration, the flow channel in the ice maker tray itself, which then constitutes a pipe section of the pipeline system of the refrigeration circuit in the state coupled to the refrigeration circuit, is then also particularly securely and leakage-free connected thereto.

Preferably, it is provided that these connection nozzles protrude to the side in raised manner, whereby a particularly simple accessibility and simple and secure connection of other channel parts of the refrigeration circuit are achieved.

The above mentioned connection nozzles can advantageously also be mechanically post-processed such that individual surface structures can again be provided here too to allow a particularly secure and leakage-free connection of other channel parts or pipe parts of a refrigeration circuit. Advantageously, an internal cross-section and/or an external cross-section of a connection nozzle is formed such that a solder connection to throttle pipes of a refrigeration circuit can optionally be effected, but a corresponding connection of suction pipes of a refrigeration circuit is also allowed.

Preferably, the tray body of the ice maker tray has a heating device for heating the form areas. This is a further very advantageous implementation, since the ice form elements produced in the form areas thus can be slightly molten by heat input into the form areas by the heating device and thus the removal or output of these ice form elements from the form areas can be very simply effected.

Advantageously, the heating device is in particular also additionally formed to thaw frost and ice formed on other surfaces of the ice maker tray.

An ice maker according to the invention for a household refrigeration apparatus has an ice maker tray. The ice maker tray includes a tray body. The ice maker tray also includes form areas for presetting forms for ice form elements to be produced, wherein these form areas are integrated in the tray body. The tray body and the form areas thus present an integral structural member.

The ice maker tray has a flow channel for a fluid or refrigerant, which is integrated in the tray body. The flow channel has a channel axis. The flow channel is closed in circumferential direction around the channel axis. In particular, this flow channel is formed closed in circumferential direction around the channel axis viewed over its entire length along the channel axis.

The ice maker can be advantageously supplemented by further features of the ice maker tray, as they were explained.

The ice maker can also have a refrigeration circuit, by which heat extraction from the area of the ice maker can be performed, in which the ice maker tray is disposed. The refrigeration circuit can have an evaporator and thus also include a heat exchanger. In particular, the flow channel of the ice maker tray constitutes a heat exchanger structural member or the heat exchanger. The flow channel is in particular formed and shaped such that it constitutes this heat exchanger structural member and provides the functionality of the heat exchanger upon passage of a fluid like a refrigerant, which flows in a refrigeration circuit, through the flow channel.

A household refrigeration apparatus according to the invention includes an ice maker. The ice maker has an ice maker tray. This ice maker tray includes a tray body as well as form areas for presetting forms for ice form elements to be produced. These form areas are integrated in the tray body and thus produced integrally with it. The ice maker tray has a flow channel for a fluid, which is integrated in the tray body. The ice maker tray has a flow channel, which has a channel axis. In particular, the flow channel is closed in circumferential direction around the channel axis.

A further aspect of the invention relates to an ice maker tray for an automatic ice maker of a household refrigeration apparatus. The ice maker tray has a tray body. The ice maker tray has form areas for presetting forms for ice form elements to be produced, wherein these form areas are integrated in the tray body. Therefore, they are formed integrally with the tray body and in particular also produced integrally with the tray body. The ice maker tray includes at least one heat exchanger structural member of a heat exchanger. The heat exchanger structural member is integrated in the tray body and thus in particular formed integrally with this tray body. The ice maker tray thus has a heat exchanger in the tray body itself in non-destructively non-detachable manner.

A further aspect of the invention relates to an ice maker tray for an automatic ice maker for a household refrigeration apparatus. The ice maker tray includes a first ice maker tray part, in which form areas are formed. Forms for ice form elements to be produced are preset by the form areas. The ice maker tray has a second ice maker tray part, which is connected to the first ice maker tray part. The two ice maker tray parts are provided as separate components in their then already respective final shape before connection and are then connected. The ice maker tray has a channel like a flow channel for a refrigerant, which is formed between the first ice maker tray part and the second ice maker tray part. The channel has a first channel wall bounding the channel, which is formed by a wall of the first ice maker tray part. The channel is directly bounded by this wall. The channel has a second channel wall bounding the channel, which is formed by a wall of the second ice maker tray part. The channel is directly bounded by this further wall of the second ice maker tray part.

The channel has a channel inlet, which is formed or bounded by at least one ice maker tray part. The channel has a channel outlet, which is formed or bounded by at least one ice maker tray part.

In this aspect of the invention, the channel is completely closed viewed in circumferential direction around its channel axis and it is formed by a wall area of the first ice maker tray part in this circumferential direction in sections and by a wall area of the second ice maker tray part in another section in this circumferential direction.

In particular, the two ice maker tray parts are formed groove-like or as grooves in the wall areas bounding the channel and forming these channel walls.

In particular, the channel is closed in circumferential direction around the channel axis over its entire length viewed in the direction of its channel axis.

In particular, the invention also includes an ice maker, which has an ice maker tray according to the mentioned further aspects of the invention. A household refrigeration apparatus is also encompassed by the invention, which has an ice maker with such an ice maker tray according to the mentioned further aspects of the invention. It can be provided that a throttle pipe of a refrigeration circuit of an ice maker or a household refrigeration apparatus is connected to a channel inlet of a channel or a flow channel and thereby the channel of the ice maker tray is thus incorporated in the refrigeration circuit such that a refrigerant is evaporated in this channel, in particular a substantial portion of the refrigerant is evaporated. It can also be provided that the channel or flow channel of the ice maker tray presents a segment of a suction pipe of a refrigeration circuit of an ice maker or a household refrigeration apparatus and a provided residual portion of the fluid, which then presents a refrigerant of the refrigeration circuit, is evaporated, in particular post-evaporated, in the channel of the ice maker tray. It can also be provided that the channel of the ice maker tray constitutes a segment of a suction pipe of a refrigeration circuit, to which the ice maker tray is coupled, and that gaseous fluid or refrigerant substantially already evaporated flows through the channel of the ice maker tray at low pressure. In the aspects of the ice maker tray, a channel wall of a flow channel, which thus bounds the flow channel or the cavity of the flow channel, is also a bounding wall of form areas of this ice maker tray at the same time. This integrally produced structural member in the form of this wall area allows faster heat extraction from the form areas when fluid in the form of refrigerant flows through this channel. This acceleration is also in particular achieved because two separate surfaces, in particular metallic surfaces, of two separate components do not contact each other compared to the prior art. The delays in heat extraction and thus in the ice rate occurring due to this interface and the respective wall thicknesses of the individual ones of the two wall areas can be avoided by the invention.

Thus, the ice maker tray is in particular itself formed as an evaporator in certain areas if it is incorporated in a refrigeration circuit of an ice maker. In this context, it can also serve as a post-evaporator. Especially by the specific advantageously mentioned geometry, in which the channel ends in the form of the channel inlet and the channel outlet have a smaller cross-sectional area than a channel main part located in between viewed in the direction of the channel axis, this functionality as an evaporator or post-evaporator is achieved to particular extent. Especially in this configuration and with the expanded configuration of the channel main part, the fluid in the form of the refrigerant can flow through and evaporate therein and the maximally possible cooling power can thereby be achieved directly at the ice maker tray itself and especially in the area, where the form areas are also formed.

A throttle pipe can be directly connected to the channel inlet, however, alternatively also a suction pipe of a preceding evaporator of the refrigeration circuit, wherein the flow channel then serves as a post-evaporator to post-evaporate excess refrigerant. In such a configuration, slight overfilling of the actual first evaporator can then also be deliberately ensured. The preferred implementation, in which a throttle pipe or a suction pipe is connected to the flow channel or the ice maker tray and an associated amount of fluid or amount of refrigerant is present, can then be adapted individually to the situation and thus the design of the refrigeration technology of the household refrigeration apparatus.

It can also be provided that the ice maker tray is varnished at least in certain areas, in particular in the form areas.

The mentioned heating device can also operate as an evaporator defrosting heater besides its function as a meltout heater for the ice form elements. Thereto, two different separate heating devices can also be provided, one of which operates as a meltout heater and the other of which as an evaporator defrosting heater. Thereby, a more adequate and energy efficient design and mode of operation can optionally be allowed.

In particular, the connection nozzles at the channel inlet and the channel outlet are formed unvarnished, whereby the tight connection of pipes of the refrigeration circuit to these connection nozzles is improved. It can be provided that the arrangement of an evaporator in the entire ice maker or in a dispenser unit, which is formed at least for dispensing ice form elements, corresponds to that in a meltout ice maker. It is particularly advantageous to select the arrangement and the assembly order of the components such as for example the motor for moving an ejector for ejecting the ice form elements from the ice maker tray such that they can be assembled to and again disassembled from the household refrigeration apparatus independently of the evaporator. Preferably, the evaporator is assembled as the first component and thereby connected to the refrigeration circuit. Thereto, the pipes or lines carrying the refrigerants are then in particular connected to the ice maker tray before the other components are added. This is reasonable because the accessibility to the components is then even simpler with respect to the assembly in the production. However, this also has advantages with regard to the positioning of the components in the apparatus such that the accessibility for service staff or servicing is simplified also in a finished household refrigeration apparatus since other components of the household refrigeration apparatus are optionally more high-maintenance and therefore positioned at locations more easily accessible or further outwards than the ice maker tray and the evaporator. By the configuration of the invention, it is also possible that an evaporator temperature nevertheless can be maintained at higher temperature compared to an evaporator disposed far from the ice maker tray, which is more advantageous in terms of energy. By the configuration of the ice maker tray, moreover, a very compact and stable construction is also achieved. Moreover, it is simply possible to maintain the temperature of the ice maker in the range between minus 2° C. and minus 7° C. and to obtain only low air velocities. The ice storage area is formed by a receptacle, in particular a tub-like receptacle, in the ice maker, into which the produced ice form elements are introduced after ejection from the ice maker tray and are further correspondingly maintained in frozen state before they are then dispensed at a dispensing unit of the dispenser unit. In this context, it is then also allowed by the invention compared to the prior art that these ice form elements ejected from the ice maker tray and intermediately stored in the ice storage area are subjected to lower sublimation and also undesirably deep temperatures do not exist in this ice storage area compared to conventional configurations, as they occur in concepts, in which external evaporators are employed spaced from the ice maker tray. Moreover, this higher temperature in the ice storage area also allows keeping the insulation strength between the ice maker and the refrigerating compartment lower in ice makers, which are disposed in a refrigerating compartment of a household refrigeration apparatus in certain areas, which also entails further advantages with respect to the space requirement. Moreover, it can be possible to operate the entire ice maker system or the entire ice maker without a circulation fan, which also has again advantages with respect to space requirement, noise development and reduced maintenance as well as reduced energy consumption.

With indications of "top", "bottom", "front", "rear", "horizontal", "vertical", "depth direction", "width direction", "height direction" etc., the positions and orientations with intended use and intended arrangement of the ice maker tray and the apparatus, respectively, are specified.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not have all of the features of an originally formulated independent claim. Moreover, implementations and feature combinations are to be considered as disclosed, in particular by the implementations set out above, which extend beyond or deviate from the feature combinations set out in the relations of the claims.

BRIEF DESCRIPTION OF THE DRAWINGS

Below, embodiments of the invention are explained in more detail based on schematic drawings. There show.

PREFERRED IMPLEMENTATION OF THE INVENTION

Figure 1:
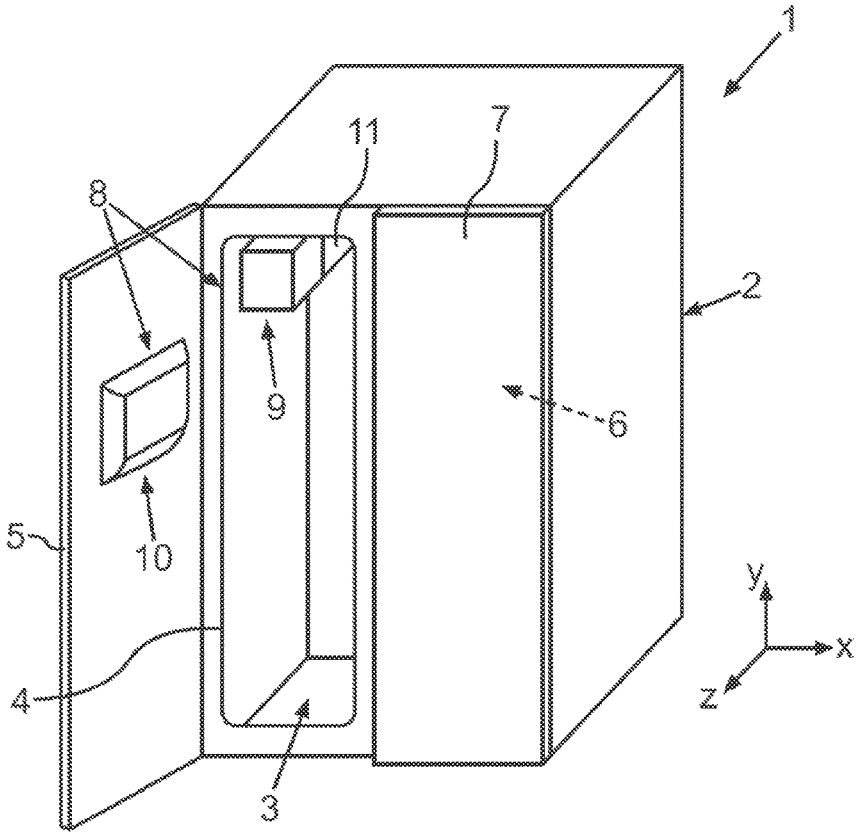
FIG. 1 a perspective simplified representation of an embodiment of a household refrigeration apparatus according to the invention.

In FIG. 1, an embodiment of a household refrigeration apparatus 1 is shown in a perspective representation. Here, the household refrigeration apparatus 1 is a combined refrigerator-freezer and formed for storing food. The household refrigeration apparatus 1 can be formed only as a refrigerator or only as a freezer in an alternative implementation.

In the implementation shown in FIG. 1, the household refrigeration apparatus 1 has a housing 2. A refrigerating compartment 3 is formed in the housing 2, which is bounded by walls of an interior container 4. The household apparatus 1 includes a first door 5, which is pivotably disposed at the housing 2. In the closed state of the door 5, the refrigerating compartment 3 is closed by this door 5 on the front side. In FIG. 1, the door 5 is shown in the opened position.

Moreover, the household refrigeration apparatus 1 includes a freezing compartment 6 separated from the refrigerating compartment 3. The household refrigeration apparatus 1 has a second door 7, which is formed for closing the freezing compartment 6. In FIG. 1, the door 7 is shown in the closed state. The two doors 5 and 7 are front-side termination parts of the household refrigeration apparatus 1 and are disposed next to each other and in particular also in the same plane in the closed state.

As alternative implementations of a household refrigeration apparatus 1, which has a refrigerating compartment and a freezing compartment, it can also be provided that the refrigerating compartment 3 and the freezing compartment 6 are not formed next to each other, but formed one above each other in vertical direction (y-direction) and thus in height direction of the household refrigeration apparatus 1. Then, it can be provided that this refrigerating compartment 3 disposed at the top is closed by a single door or is closable by two doors disposed next to each other and respectively disposed pivotably at the housing 2. The freezing compartment located below is then closable by a door separate therefrom. This door for closing the freezing compartment can also be a front wall of a drawer, which is disposed retractable into and extractable from the freezing compartment and thus is in particular disposed displaceable in depth direction (z-direction).

The household refrigeration apparatus 1 includes a dispenser unit 8, which is formed for dispensing ice form elements. In addition, the dispenser unit 8 can also be formed for dispensing a liquid such as a drink. The dispenser unit 8 has an ice maker 9. In the shown implementation, the ice maker 9 is disposed in the refrigerating compartment 3 at least in certain areas and in particular accessible via the front-side loading opening of the refrigerating compartment 3 only with opened door 5. However, on the other hand, the ice maker 9 is disposed therein thermally insulated from the remaining volume of the refrigerating compartment 3. The dispenser unit 8 also has a dispensing unit 10, which is disposed at the door 5 in the shown implementation. The ice form elements produced in the ice maker 9 can be conveyed into the dispensing unit 10 via a conveying unit and dispensed in the closed state of the door 5. Thereto, the door 5 has a recess on its front side, which faces away from the refrigerating compartment 3 in the closed state, in which a receiving vessel, for example a drinking glass, can be placed, and into which the ice form elements can then fall into the receiving vessel via a dispensing opening of the dispensing unit.

The ice maker 9 in particular has a receiving container, which is formed as an ice storage area. In it, ice form elements like ice cubes or crushed ice are stored in the ice maker 9 until dispensing is to be effected via the dispensing unit 10. In particular, the ice maker 9 also has a conveying unit, for example a conveying screw, by which the ice form elements stored in this receiving container can be conveyed and can be conveyed to the dispensing unit 10. Thereto, a chute can for example be provided, which connects this receiving container in the ice maker 9 and the dispensing unit 10. This is realized in the closed state of the door 5.

Moreover, the ice maker 9 includes a refrigerating circuit 11, which is exemplarily shown in FIG. 1 and presented as a symbol. The refrigeration circuit 11 preferably has a condenser and a compressor as well as an evaporator. The evaporator, which is also to be referred to as heat exchanger, is a constituent of an ice maker tray or an ice form tray. This ice maker tray is a further separate component of the ice maker 9 and disposed in the ice maker 9 or a housing of the ice maker 9.

The ice maker 9 is an automatic ice maker, by which ice form elements can be produced by the configuration with the refrigeration circuit 11.

Figure 2:
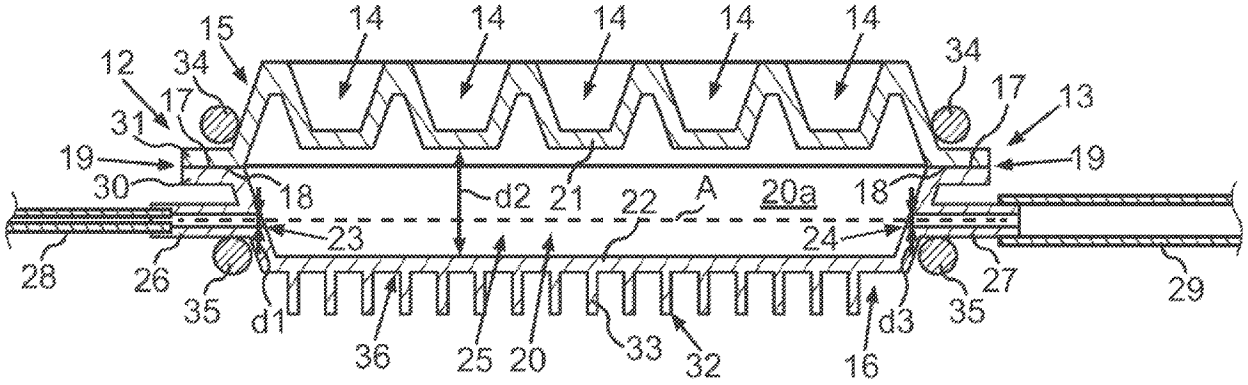
FIG. 2 a schematic sectional representation through an embodiment of an ice maker tray according to the invention.

In FIG. 2, an embodiment of an ice maker tray 12 for an ice maker 9 is shown in a simplified sectional representation. The ice maker tray 12 has a tray body 13. The tray body 13 has form areas 14, which are formed as troughs. These form areas 14 preset a form for ice form elements to be produced. Liquid, in particular water, is introduced into these form areas 14 and then frozen by the ice maker 9. The form areas 14 are integrated in the tray body 13 and thus produced integrally with this tray body 13. In the shown embodiment, the tray body 13 has a first ice maker tray part 15 and a second ice maker tray part 16. The two ice maker tray parts 15 and 16 are manufactured and provided as respectively individual, in particular integral components and are then non-destructively non-detachably connected afterwards. In FIG. 2, the manufactured final state of the tray body 13 is shown. The first ice maker tray part 15 has a connection surface 17, which is circumferentially closed and thus free of interruption. The second ice maker tray part 16 also has a connection surface 18, which is circumferentially closed. As is shown in FIG. 2, these two ice maker tray parts 15 and 16 abut on these connection surfaces 17 and 18 as large in surface as possible. At least one junction 19 is formed on these connection surfaces 17 and 18, which presents a non-destructive non-detachable junction. This junction 19 can be a solder joint or welded joint or an adhesive joint. Preferably, it is also formed completely circumferentially and thus free of interruption. The junction 19 is a hermetically sealed junction.

The tray body 13 has a flow channel 20, which is integrated in the tray body 13. The flow channel 20 is therefore formed integrally with the tray body. The flow channel 20 has a channel axis A. The flow channel 20 is formed completely closed viewed in circumferential direction around this channel axis A. The flow channel 20 is bounded by walls, whereby a hollow space 20*a* of the flow channel 20 forms. The tray body 13 has a wall 21, which bounds both the form areas 14 and the flow channel 20. This wall 21 presents a channel wall of the flow channel 20 and bounds a cavity or a hollow space 20*a* of this flow channel 20. In the shown embodiment, this channel wall bounding the flow channel 20 is formed by the wall 21 of the tray body 13. In the shown embodiment, the wall 21 is a wall of the first ice maker tray part 15.

Moreover, the flow channel 20 is bounded by a further wall 22. Therefore, the wall 22 also presents a channel wall, which bounds the cavity or the hollow space 20*a* of the flow channel 20. This wall 22 is integrated in the second ice maker tray part 16 in the shown embodiment.

In particular, the flow channel 20 is formed completely closed in circumferential direction around the channel axis A viewed over its entire length along this channel axis A.

The flow channel 20 is formed for conducting or flow-through of a fluid. The fluid can be gaseous or liquid. However, the fluid can also be a mixed form of these two aggregate states. The fluid is a refrigerant of a refrigeration circuit as it can be exemplarily realized above by the refrigeration circuit 11.

The flow channel 20 has a channel inlet 23. The flow channel 20 moreover has a channel outlet 24. Further, the flow channel 20 has a channel main part 25, which extends along the channel axis A between the channel inlet 23 and the channel outlet 24.

In the embodiment, it is provided that a cross-sectional area of the channel inlet 23 is smaller than a cross-sectional area of the channel main part 25. The cross-sectional area of the channel outlet 24 is also smaller than one of the channel main part 25 in the embodiment. The cross-sectional areas are symbolically indicated by d1, d2 and d3 in FIG. 2. The cross-sectional area d2 of the channel main part 25 is shown at the smallest location of this cross-section area. The cross-sectional areas d1, d2 and d3 are oriented perpendicularly to the channel axis A.

In the shown embodiment, the channel inlet 23 is formed as a connection nozzle 26, which is formed protruding in raised manner. In the embodiment, it is also provided that the channel outlet 24 is also formed as a connection nozzle 27 and thus also extends further outwards than the wall dimension or wall thickness with respect to its extension in the wall 22. A pipe 28 is connected to the connection nozzle 26, which is a structural member of the refrigeration circuit 11 and not a constituent of the ice maker tray 12. A pipe 29 is also connected to the connection nozzle 27, which is also a constituent of the refrigeration circuit 11 and not a constituent of the ice maker tray 12.

In the embodiment according to FIG. 2, the channel inlet 23 and also the connection nozzle 26 is formed in the second ice maker tray part 16. The connection nozzle 26 is an integral constituent of this second ice maker tray part 16. The same also applies to the connection nozzle 27, which is completely formed in the second ice maker tray part 16 and integrated therein. As is apparent, the connection nozzles 26 and 27 are formed spaced from the junction 19. The connection nozzles 26 and 27 are formed and disposed on a side of the junction 19 opposing the form areas 14 in this vertical sectional representation according to FIG. 2. The connection nozzles 26 and 27 are also disposed spaced and below a flange 30. The flange 30 is an integral constituent of the second ice maker tray part 16 and this flange 30 has the connection surface 18. Correspondingly, the ice maker tray part 15 has a flange 31, which has the connection surface 17.

In the embodiment, the second ice maker tray part 16 is formed of metal at least in certain areas, in particular formed completely of metal. This first ice maker tray part 15 too is formed of metal at least in certain areas, in particular in complete manner.

The tray body 13 can be a metal die casting component, wherein the two ice maker tray parts 15 and 16 each can be metal die casting components in the shown embodiment according to FIG. 2.

The tray body 13 has a surface increasing structure 32. The surface increasing structure 32 is formed by a plurality of ribs 33 in the embodiment, which are spaced and in particular oriented parallel to each other. In the shown embodiment, the surface increasing structure 32 is integrated in the second ice maker tray part 16. Thus, the ribs 33 are formed integrally with the second ice maker tray part 16. This surface increasing structure 32 is disposed on the outer side of the wall 22 facing away from the form areas 14 in the embodiment. By the surface increasing structure 32 at the flow channel 20, heat is extracted from the ambient air in the ice maker and thereby the ice rate is also increased when the refrigerant flows through the flow channel 20.

At least one heating device 34 is disposed at the tray body 13. The heating device 34 can be formed as a meltout heater. This means that the wall 21 can be heated by this heating device 34, whereby the ice form elements frozen in the form areas 14 can be easily thawed and thus ejection of these ice form elements from the form areas 14 is simplified. In addition, the heating device 34 can also be a defrosting heating device, which is formed for defrosting frost or ice at the tray body 13, for example at the second ice maker tray part 16. However, the functionality as a defrosting heating device can also be realized by a separate heating device 35.

The ice maker tray 12 can also have a tray body 13. This ice maker tray 12 has form areas 14 for presetting forms for ice form elements to be produced. The form areas 14 are integrated in the tray body 13. The ice maker tray 12 has at least one heat exchanger structural member 36, which is integrated in the tray body 13 and thus formed integrally with this tray body 13. In particular, this heat exchanger structural member 36 is formed by the flow channel 20. It can also be provided that the heat exchanger structural member 36 constitutes an entire heat exchanger.

A channel of an ice maker tray 12, which is formed integrated in the ice maker tray 12 is in particular the flow channel 20.

In particular, the channel inlet 23 is formed in an ice maker tray part, in particular the second ice maker tray part 16. Preferably, the channel outlet 24 is integrally formed at the same ice maker tray part, in particular at the second ice maker tray part 16.

It can be provided that the tray body 13 is varnished at least in certain areas.

Figure 3:
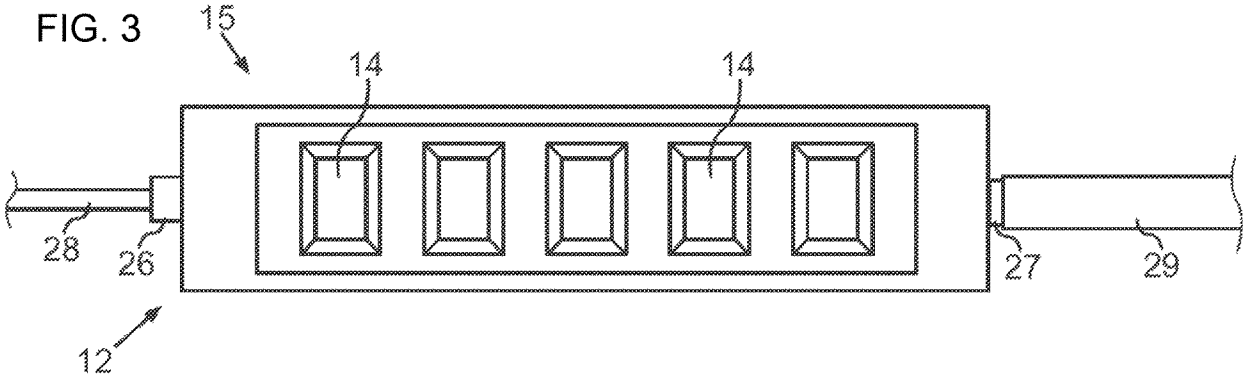
FIG. 3 a plan view of the ice maker tray according to FIG. 2.

In FIG. 3, a plan view of the configuration according to FIG. 2 is shown. Here, it is looked into the form areas 14 from above.

Figure 4:
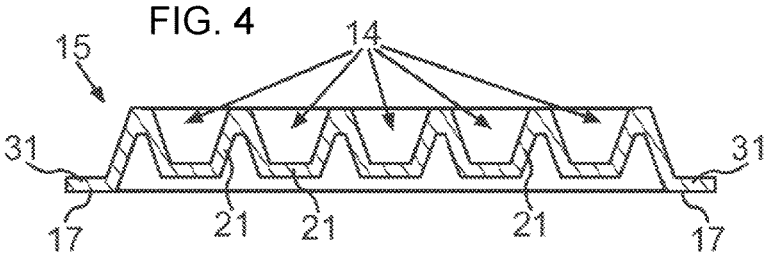
FIG. 4 a sectional representation through an ice maker tray part of the ice maker tray according to FIG. 2.

In FIG. 4, the first ice maker tray part 15 according to the implementations in FIG. 2 and FIG. 3 is shown alone.

Figure 5:
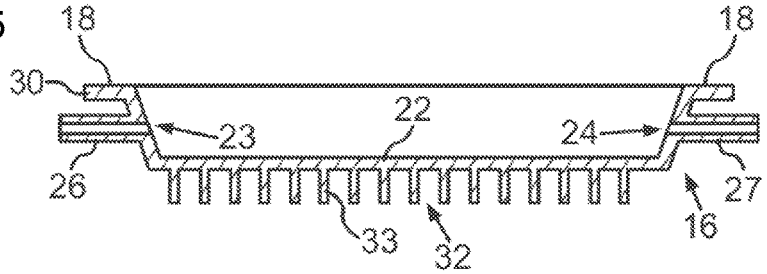
FIG. 5 a sectional representation through a second ice maker tray part of the ice maker according to FIG. 2.

In FIG. 5, the second ice maker tray part 16 of the implementation in FIG. 2 and FIG. 3 is illustrated.

Figure 6:
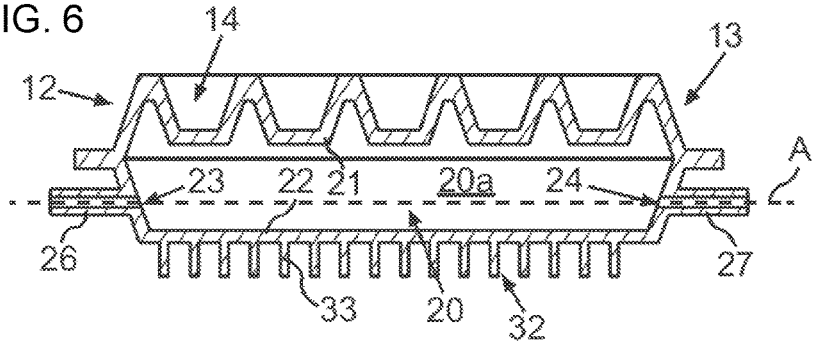
FIG. 6 a sectional representation through a further embodiment of an ice maker tray.

In FIG. 6, a further embodiment of an ice maker tray 12 is shown. The shaping and configuration corresponds to that ice maker tray 12 according to FIG. 2 to FIG. 5. In this implementation, it can be provided that the tray body 13 is formed as one piece and is already produced as a single piece. The perfectly structured ice maker tray parts 15 and 16 first pre-fabricated as individual structural members in the implementation according to FIG. 2 to FIG. 5, which are then non-destructively non-detachably connected, are already integrally formed here in a manufacturing process. Therefore, the junction 19 is not present in this implementation. Here too, a hollow space 20*a* of the channel, in particular of the flow channel 20, is virtually formed as an evaporator space as it is also provided in the implementations as they were explained to FIG. 2 to FIG. 5.

LIST OF REFERENCE CHARACTERS

1 Household refrigeration apparatus
2 housing
3 refrigerating compartment
4 interior container
5 door
6 freezing compartment
7 door
8 dispenser unit
9 ice maker
10 dispensing unit
11 refrigeration circuit
12 ice maker tray
13 tray body
14 form area
15 first ice maker tray part

16 second ice maker tray part
17 connection surface
18 connection surface
19 junction
20 flow channel
20*a* hollow space
21 wall
22 wall
23 channel inlet
24 channel outlet
25 channel main part
26 connection nozzle
27 connection nozzle
28 pipe
29 pipe
30 flange
31 flange
32 surface increasing structure
33 ribs
34 heating device
35 heating device
36 heat exchanger structural member
A channel axis
d1, d2, d3 cross-sectional area

The invention claimed is:

1. A refrigeration apparatus comprising:
an ice maker tray including:
a tray body disposed in a refrigerant circuit of the ice maker,
form areas for presetting forms for ice form elements to be produced, the form areas being integrated in the tray body,
a flow channel for a refrigerant fluid of the refrigerant circuit, the flow channel being integrated in the tray body and extending between the form areas, the flow channel having an inlet, a main portion, and an outlet, the main portion being expanded with respect to the inlet and the outlet for defining an evaporator of the refrigerant circuit,
the flow channel having a channel axis, and
the flow channel being closed in circumferential direction around the channel axis.

2. The refrigeration apparatus according to claim 1, wherein the tray body is formed of metal.

3. The refrigeration apparatus according to claim 2, wherein the tray body is formed as a metal die casting component.

4. The refrigeration apparatus according to claim 1, wherein
the tray body has a first ice maker tray part with the form areas,
the tray body has a second ice maker tray part separate from the first ice maker tray part, which is connected to the first ice maker tray part,
the flow channel is formed between the first ice maker tray part and the second ice maker tray part, wherein
the flow channel has a first channel wall bounding the flow channel, which is formed by a wall of the first ice maker tray part,
the flow channel has a second channel wall bounding the flow channel, which is formed by a wall of the second ice maker tray part, wherein
the flow channel has a channel inlet, which is formed by at least one of these two ice maker tray parts, and
the flow channel has a channel outlet, which is formed by at least one of these two ice maker tray parts.

5. The refrigeration apparatus according to claim 4, wherein at least one junction is formed between the first ice maker tray part and the second ice maker tray part and the junction is hermetically sealed.

6. The refrigeration apparatus according to claim 5, wherein the junction is a welded joint or a solder joint or an adhesive joint.

7. The refrigeration apparatus according to claim 4, wherein
the channel inlet is completely disposed in the first ice maker tray part, and
the channel outlet is completely disposed in the second ice maker tray part.

8. The refrigeration apparatus according to claim 4, wherein the first ice maker tray part is formed as one piece and the second ice maker tray part is formed as one piece.

9. The refrigeration apparatus according to claim 1, wherein the tray body has a surface increasing structure.

10. The refrigeration apparatus according to claim 9, wherein the flow channel is bounded by a channel wall and the form areas are formed in the channel wall, and the flow channel is bounded by a further channel wall, and the further channel wall has the surface increasing structure.

11. The refrigeration apparatus according to claim 9, wherein the surface increasing structure has ribs.

12. The refrigeration apparatus according to claim 9, wherein the surface increasing structure is integrated in the tray body.

13. The refrigeration apparatus according to claim 1, wherein
the inlet is formed as a connection nozzle, and
the outlet is formed as a connection nozzle.

14. The refrigeration apparatus according to claim 1, wherein the tray body has a heating device for heating the form areas.

15. A refrigeration apparatus comprising:
an ice maker including:
a refrigerant circuit;
an ice maker tray having:
a tray body disposed in the refrigerant circuit,
form areas for presetting forms for ice form elements to be produced, the form areas being integrated in the tray body,
a flow channel for a refrigerant fluid of the refrigerant circuit, the flow channel being integrated in the tray body, the flow channel having an inlet, a main portion, and an outlet, the main portion being expanded with respect to the inlet and the outlet for defining an evaporator of the refrigerant circuit, the form areas extending into the flow channel,
the flow channel having a channel axis, and
the flow channel being closed in circumferential direction around the channel axis.

16. A household refrigeration apparatus having:
an ice maker having:
a refrigerant circuit;
an ice maker tray having:
a tray body disposed in the refrigerant circuit,
form areas for presetting forms for ice form elements to be produced, the form areas being integrated in the tray body,
a flow channel for a refrigerant fluid of the refrigerant circuit, the flow channel being integrated in the tray body and extending between the form areas, the flow channel having an inlet, a main portion, and an outlet, the main portion being expanded with respect to the inlet and the outlet for defining an evaporator of the refrigerant circuit, the flow channel having a channel axis, and the flow channel being closed in circumferential direction around the channel axis.

17. A refrigeration apparatus having:

an Ice maker tray including:

a first ice maker tray part, in which form areas are formed, forms for ice form elements to be produced being preset by the form areas, a second ice maker tray part being connected to the first ice maker tray part, the first and second tray parts defining a tray body disposed in a refrigerant circuit of the ice maker, a channel for a refrigerant fluid of the refrigerant circuit, the channel being formed between the first ice maker tray part and the second ice maker tray part, the channel having an inlet, a main portion, and an outlet, the main portion being expanded with respect to the inlet and the outlet for defining an evaporator of the refrigerant circuit, a first channel wall bounding the channel being formed by a wall of the first ice maker tray part, a second channel wall bounding the channel being formed by a wall of the second ice maker tray part, the form areas extending into the channel, a channel inlet being formed by at least one of the two ice maker tray parts, and a channel outlet being formed by at least one of the two ice maker tray parts.

18. A refrigeration apparatus comprising:

a tray body disposed in a refrigerant circuit of an ice maker, form areas for presetting forms for ice form elements to be produced, the form areas being integrated in the tray body, a flow channel for a refrigerant fluid of the refrigerant circuit, the flow channel being integrated in the tray body and extending between the form areas, the flow channel having an inlet, a main portion, and an outlet, the main portion being expanded with respect to the inlet and the outlet for defining an evaporator of the refrigerant circuit.

* * * * *